US012071944B2

(12) United States Patent
Merkel et al.

(10) Patent No.: US 12,071,944 B2
(45) Date of Patent: Aug. 27, 2024

(54) METHOD AND APPARATUS FOR VIBRATION COMPENSATION IN A PISTON COMPRESSOR

(71) Applicant: KNORR-BREMSE SYSTEME FÜR SCHIENENFAHRZEUGE GMBH, Munich (DE)

(72) Inventors: Thomas Merkel, Hürth (DE); Michael Hartl, Unterhaching (DE); Stefan Schneider, Munich (DE)

(73) Assignee: KNORR-BREMSE SYSTEME FÜR SCHIENENFAHRZEUGE GMBH (DE)

( * ) Notice: Subject to any disclaimer, the term of this patent is extended or adjusted under 35 U.S.C. 154(b) by 0 days.

(21) Appl. No.: 16/310,703

(22) PCT Filed: Jun. 7, 2017

(86) PCT No.: PCT/EP2017/063769
§ 371 (c)(1),
(2) Date: Dec. 17, 2018

(87) PCT Pub. No.: WO2017/215991
PCT Pub. Date: Dec. 21, 2017

(65) Prior Publication Data

US 2019/0264676 A1 Aug. 29, 2019

(30) Foreign Application Priority Data

Jun. 17, 2016 (DE) ..... 10 2016 111 101.5

(51) Int. Cl.
*F04B 49/06* (2006.01)
*F04B 35/04* (2006.01)
(Continued)

(52) U.S. Cl.
CPC ..... *F04B 49/06* (2013.01); *F04B 35/04* (2013.01); *F04B 39/0027* (2013.01);
(Continued)

(58) Field of Classification Search
CPC ..... F04B 2203/0207; F04B 2201/0201; F04B 2201/0204; F04B 11/005; F04B 11/0058; F04B 17/03; F04B 39/0044
See application file for complete search history.

(56) References Cited

U.S. PATENT DOCUMENTS 4,726,738 A 2/1988 Nakamura et al.
2002/0121816 A1* 9/2002 Qiu ..... F16F 7/1011 310/12.24
(Continued)

FOREIGN PATENT DOCUMENTS

CN 1558545 A 12/2004
CN 1671964 A 9/2005
(Continued)

OTHER PUBLICATIONS

Search report for International Patent Application No. PCT/EP2017/063769; dated Sep. 11, 2017.

*Primary Examiner* — Philip E Stimpert
(74) *Attorney, Agent, or Firm* — Barnes & Thornburg LLP

(57) ABSTRACT

The invention relates to a method and to an apparatus for vibration compensation in a piston compressor, the piston compressor of which is driven by means of a crankshaft by a three-phase motor controlled by a frequency converter, wherein the current position the crankshaft of the piston compressor is determined, and based on this the frequency converter, a torque ($M_M$) for the three-phase motor is predetermined, which torque follows the load torque ($M_L$) of
(Continued)

the piston compressor in order to reduce the vibration stimulation of the entire piston compressor.

6 Claims, 3 Drawing Sheets

(51) Int. Cl.
*F04B 39/00* (2006.01)
*F04B 49/20* (2006.01)
*F04B 53/00* (2006.01)

(52) U.S. Cl.
CPC ..... *F04B 49/20* (2013.01); *F04B 53/001* (2013.01); *F04B 2201/02* (2013.01); *F04B 2201/1202* (2013.01); *F04B 2203/0207* (2013.01)

(56) References Cited

U.S. PATENT DOCUMENTS

2004/0163451 A1* 8/2004 Kim ..... G01M 17/08 73/115.01
2004/0227482 A1* 11/2004 Yoshida ..... B60H 1/3226 318/437
2006/0013711 A1* 1/2006 Kakiuchi ..... F04B 39/0044 417/415
2006/0125437 A1 6/2006 Kitano
2008/0315816 A1* 12/2008 Hashimoto ..... H02P 21/24 318/461
2009/0220352 A1* 9/2009 Carstensen ..... F04B 17/03 417/44.11
2012/0078222 A1* 3/2012 Smith ..... A61M 5/16877 604/506
2013/0121845 A1* 5/2013 Giewont ..... H02P 6/22 417/45
2013/0287602 A1 10/2013 Suzuki et al.
2015/0075369 A1* 3/2015 Kapadia ..... F04B 39/121 92/140
2015/0370262 A1* 12/2015 Hanaoka ..... B29C 45/76 137/557

FOREIGN PATENT DOCUMENTS

CN 101364785 A 2/2009
CN 102522941 A 6/2012
DE 10058924 A1 6/2002
DE 102013101502 A1 8/2014
EP 1858153 A2 11/2007
EP 3098448 A1 11/2016
JP H0433585 A 2/1992
JP H0454888 A 2/1992

* cited by examiner

METHOD AND APPARATUS FOR VIBRATION COMPENSATION IN A PISTON COMPRESSOR

PRIORITY CLAIM

This patent application is a U.S. National Phase of International Patent Application No. PCT/EP2017/063769, filed Jun. 7, 2017, which claims priority to German Patent Application No. 10 2016 111 101.5, filed Jun. 17, 2016, the disclosures of which are incorporated herein by reference in their entirety. METHOD AND APPARATUS FOR VIBRATION COMPENSATION IN A PISTON COMPRESSOR.

FIELD

Disclosed embodiments relate to a method and an apparatus for vibration compensation in a piston-type compressor, the piston compressor of which is driven by means of a crankshaft by a three-phase motor or the like controlled by a frequency converter. More specifically, disclosed embodiments also relate to a piston-type compressor that is equipped with such an apparatus.

BACKGROUND

In transportation vehicles, in particular rail vehicles, in principle, the installation space in vehicles is limited; as a result, quite compact piston-type compressors are usually used for this, and an electric motor is directly flange-mounted on the usually multi-stage piston compressor, in order to drive the piston compressor. The load moment $M_L$ of a piston compressor, acting together with the torque $M_M$ of a driving motor, produces an excitation moment about the axis of rotation of the entire piston-type compressor, which leads to undesired rotational vibrations.

SUMMARY

Disclosed embodiments provide a method and an apparatus for vibration compensation in a piston-type compressor that allow effective suppression of vibration in every operating situation of the piston-type compressor by simple technical means.

Disclosed embodiments provide a process for vibration compensation, wherein a first the current position of the crankshaft of the piston compressor is determined, and, based on this, a torque $M_M$ that follows the load moment $M_L$ of the piston compressor, i.e. corresponds to it, is prescribed by a frequency converter for the driving three-phase motor in order to reduce the vibration excitation of the piston-type compressor as a whole. Since the vibration excitation of the piston-type compressor arises from the difference between the torque $M_M$ of the driving motor and the load moment $M_L$, the resultant vibration excitation can be eliminated by a closed-loop control based on the solution according to the disclosed embodiments. Flywheel masses between the motor and the piston compressor can be made smaller or can be dispensed with entirely.

BRIEF DESCRIPTION OF FIGURES

Disclosed embodiments are presented in more detail below together with the description of an exemplary embodiment of the invention on the basis of the figures, in which.

DETAILED DESCRIPTION

Figure 1:
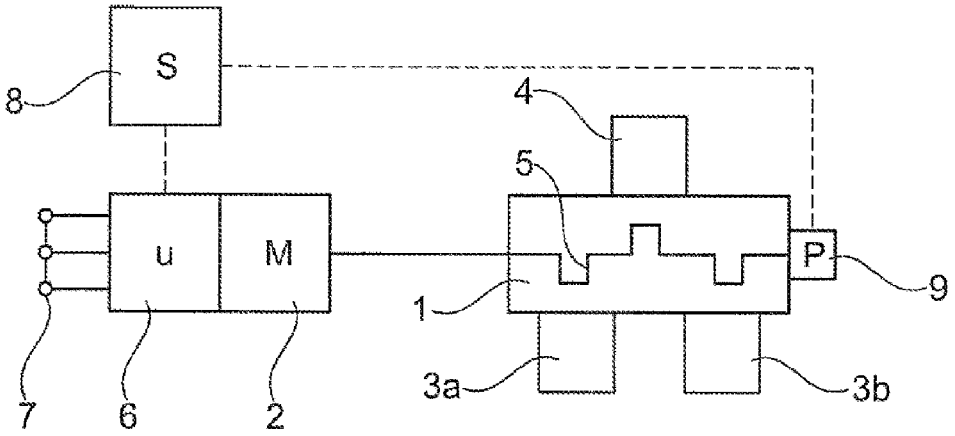
FIG. 1 shows a block circuit diagram of a piston-type compressor with an apparatus for vibration compensation integrated in it.

Since in the case of the piston-type compressors of the type of interest here, the torque $M_M$ of the motor follows the load moment $M_L$ of the piston compressor with a time delay, the excitation moment increases in an unfavorable way.

DE 100 58 923 A1 discloses a piston-type compressor of the type in question, the multi-stage piston compressor of which is driven by an electric motor directly flange-mounted on it. The piston-type compressor is fastened upright on the chassis of the vehicle by way of a number of vibration-damping wire cable springs, in order to reduce the transfer of vibration from the piston-type compressor to the vehicle.

EP 1 242 741 A1 also describes the problem of vibration excitation of piston-type compressors due to the load moment $M_L$ and motor torque $M_M$ and measures for reducing vibration that lead to types of design of two-stage piston-type compressors with reduced vibration excitation. In order to minimize the influence of the motor on the vibration excitation, flywheel masses that counteract vibration excitation were used between the motor and the piston compressor. However, this technical solution causes a corresponding expenditure of material and produces an associated increase in weight.

In practice, piston compressors are usually operated by three-phase motors, to which a frequency converter is assigned. With the aid of the frequency converter, the piston compressor can be controlled with variable speed, in order in particular to obtain production of compressed air appropriate for requirements as part of a corresponding closed-loop control, while taking into consideration minimum switch-on times, intervals in intermittent operation and the like.

Frequency converters, in particular those designed for operating rail vehicles, have so far been quite complicated in their structural design and especially quite large. Furthermore, these so-called auxiliary power converters on rail vehicles do not just supply power to a single electrical load, but to a number of loads, such as for example also air-conditioning systems, traction fans, equipment fans, compressors and the like. It has therefore not been possible so far for such a commonly used auxiliary power converter to be designed just for one single load.

Further developments of converter technology and great availability of power electronic components used in this technology mean that there are currently boundary conditions that allow frequency converters to be assigned directly to a drive and also to be placed there.

With this understanding in mind, disclosed embodiments provide a method and an apparatus for vibration compensation in a piston-type compressor that allow effective suppression of vibration in every operating situation of the piston-type compressor by simple technical means.

A three-phase motor used as part of the solution according to the disclosed embodiments includes a three-phase asynchronous motor or a synchronous reluctance motor. Optionally, the torque $M_M$ prescribed for the three-phase motor corresponds to the load moment profile including a phase length. However, it is also conceivable that the torque $M_M$ prescribed for the three-phase motor corresponds to the first order of the load moment profile. Tests have shown that a vibration compensation method that is quite easy to implement but very effective is in fact that of just recreating the component of the first order in the motor torque $M_M$. Higher orders are in this case ignored. The basis for this is the resilient mounting of the piston-type compressor. This mounting is designed such that excitations above a certain frequency are kept away from connecting structures. This has proven to be sufficient under these circumstances. Higher orders are largely kept away from the resilient mountings. For this reason, it is sufficient to eliminate vibration excitations up to and including the first order by the method according to the disclosed embodiments.

It is similarly sufficient if the deviation of the load moment $M_L$ of the piston compressor following the torque $M_M$ for the three-phase motor is set in such a way that it is less than 30%. Within this deviation range, the torque $M_M$ of the three-phase motor only approximately follows the load moment $M_L$ of the piston compressor, which nevertheless produces effective vibration compensation. It has been found under all the structural boundary conditions that the entire vibration behavior can be improved by the electronic compensation according to the disclosed embodiments by up to 70%, while the vibration displacements of the piston-type compressor are significantly reduced, in particular at low rotational speeds.

According to a further optional measure that improves the disclosed embodiments, it is proposed that, to compensate for fluctuations in speed, the torque $M_M$ generated by the three-phase motor is produced by a variation of the feed voltage and/or a variation of the pulse width in the converter. Consequently, for example, an increase of the torque $M_M$ can be achieved by the pulse width being increased for a short time. In this way, the pulsating load moments usually produced by the piston compressor are smoothed within the compressor, so that the vibration excitation caused by this is minimized further. Since the torque $M_M$ of the three-phase motor is proportional to the motor current, a torque compensation is achieved by a counteracting control of the motor current. The torque peak can be compensated by a corresponding control of the IGBT pulse width, and consequently by a motor current changed in this moment. Correspondingly quick control and a stable intermediate-circuit voltage are required for this so-called "space vectoring modulation".

Optionally, an increase of the torque $M_M$ for the three-phase motor can be carried out by the frequency converter in an easy way by a corresponding increase of the operating voltage. A control unit provided for carrying out the method according to the disclosed embodiments for vibration compensation may advantageously be integrated directly in the frequency converter. The frequency converter itself is optionally arranged directly on the three-phase motor in order to ensure easy connection to the three-phase source. Furthermore, this electronic structural unit may also have at least one sensor input, in order to connect to it a position sensor arranged in the region of the motor shaft or the crankshaft for measuring the current angular position. Optionally, the torque requirement that is to be adjusted according to the rotational speed is stored in the logic of the control unit implemented in the frequency converter.

FIG. 1 shows a piston-type compressor substantially consisting of a piston compressor 1 and a three-phase motor 2. The piston compressor 1 is formed as a two-stage compressor unit and here comprises two low-pressure cylinders 3*a*, 3*b* and a high-pressure cylinder 4. Coming from the atmosphere, the compressed air is first pre-compressed in the low-pressure cylinder 3*a*, 3*b* and then brought to an even higher pressure level by the high-pressure cylinder 4, before this compressed air that is produced is passed on for further use in the vehicle.

For actuating the piston drive of pistons—not shown any further—of the cylinders 3*a*, 3*b* and 4, the piston compressor 1 has a crankshaft 5, which is driven by the three-phase motor 2. The electrical three-phase motor 2 is equipped with a frequency converter 6, by way of which the connection to a three-phase system 7 is made. The frequency converter 6 is assigned an electronic control unit 8, which is structurally integrated in it. On the input side, the electronic control unit 8 receives the measurement signal of a position sensor 9, which is arranged in the region of the crankshaft 5 and prescribes the current angular position of the crankshaft 5 to the electronic control unit 8.

Figure 2:
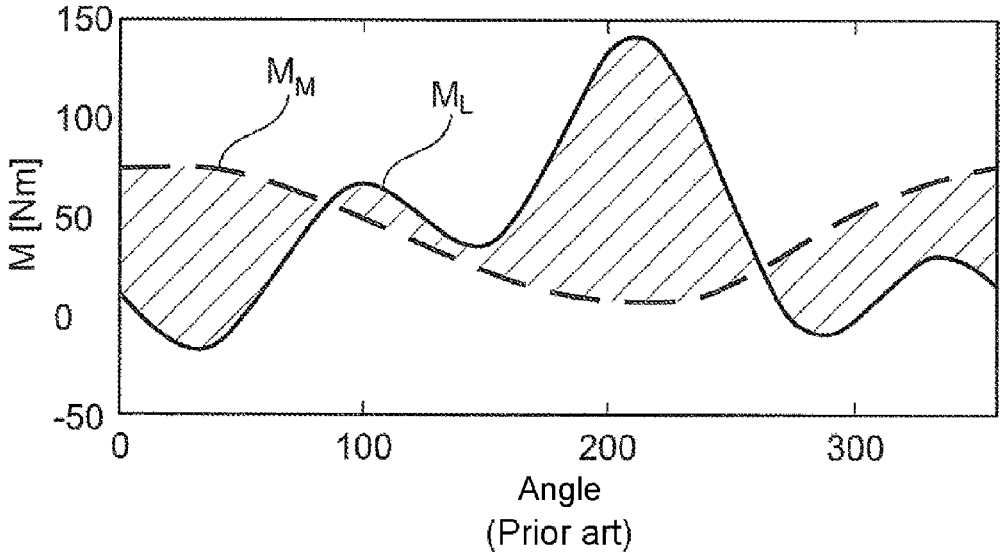
FIG. 2 shows a graphic representation of the rotational vibrations produced by the motor and the compressor according to the prior art.

FIG. 2 shows in a graphic representation the torque profile with respect to a complete revolution of 0 to 360° of the crankshaft of a piston compressor of the prior art. The average torque of the drive is at approximately 50 Nm (dotted line). It can be seen in the profile of the load moment $M_L$ that, on account of a pressure peak at an angular position of the crankshaft of about 200°, it has a maximum of approximately 140 Nm. The profile of the load moment $M_L$ that is shown is characteristic of two-stage piston compressors, as illustrated in FIG. 1. The motor only responds to the dominant pressure peak after a time delay and, as can be seen, only builds up the motor torque $M_M$ with a phase offset at an angular position of the crankshaft of about 0°. Consequently, the maximum motor torque $M_M$ of about 75 Nm only comes into effect when the load moment $M_L$ of the piston compressor has already fallen, here has even reached its minimum. Due to this effect, depending on their type of design, three-phase motors even increase the rotational vibration excitation in interaction with the piston compressors driven by them. The dominant pressure peak of the load moment $M_L$ of about 150 Nm results from the compression of the second stage, to be specific the high-pressure cylinder. The three-phase drive responds to this pressure peak and builds up its torque $M_M$ of the profile shown. The area between the load moment $M_L$ and the torque $M_M$ of the motor is marked here by hatching and represents a measure of the vibration excitation around the crankshaft of the piston compressor. Because of the hatched area having quite a large area content, a relatively great disadvantageous vibration excitation is to be assumed.

Figure 3:
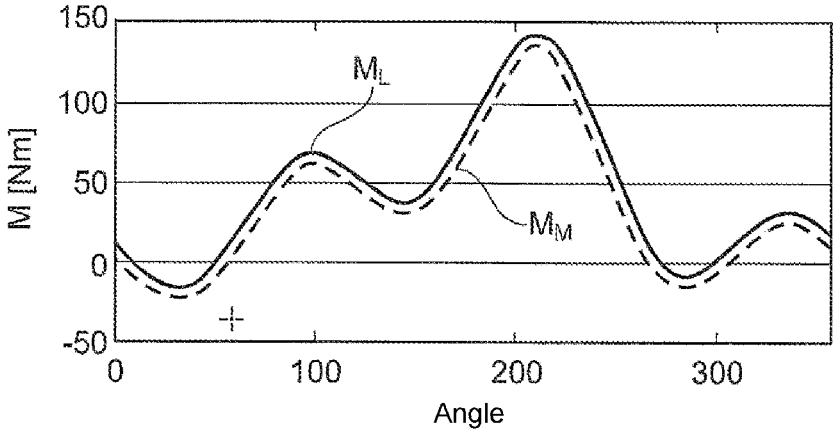
FIG. 3 shows a graphic representation of the rotational vibrations produced by the motor and the compressor according to the solution according to the disclosed embodiments with regard to a first embodiment.

FIG. 3 shows the torque profile of the torque $M_M$ of the motor and of the load moment $M_L$ of the piston compressor for a full revolution of the crankshaft as a consequence of the vibration compensation according to the disclosed embodiments. In the case of this embodiment, the control of the motor takes place in such a way that its torque $M_M$ follows the load moment $M_L$ of the piston compressor. This has the result that the area content of the area between the load moment $M_L$ and the motor torque $M_M$ is minimal as compared with the prior-art embodiment explained above, so that a very small vibration excitation takes place. This is so because, on account of the control according to the disclosed embodiments, the driving motor builds up its torque $M_M$ synchronously and to this extent in a requirement-controlled manner with respect to the load moment $M_L$ of the piston compressor that is to be handled. Because there are only minimal non-uniformities, there is a similarly minimal vibration excitation.

Figure 4:
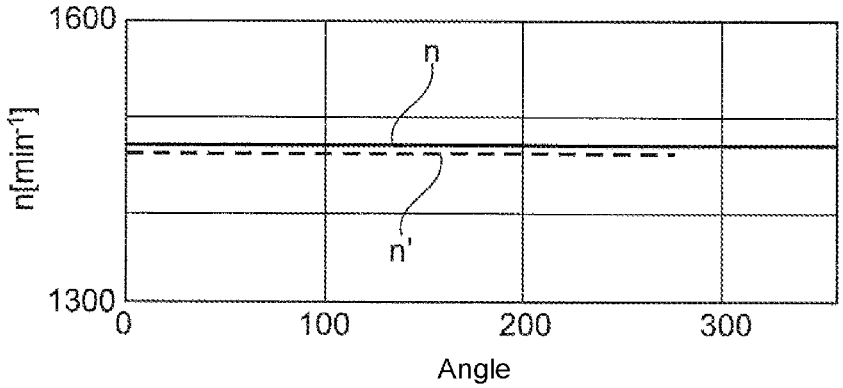
FIG. 4 shows a graphic representation of the speed profile in the case of the first embodiment.

FIG. 4 illustrates as a consequence of this a uniform profile of the rotational speed n of the crankshaft over the entire revolution. This also corresponds approximately to the average profile of the rotational speed n'.

Figure 5:
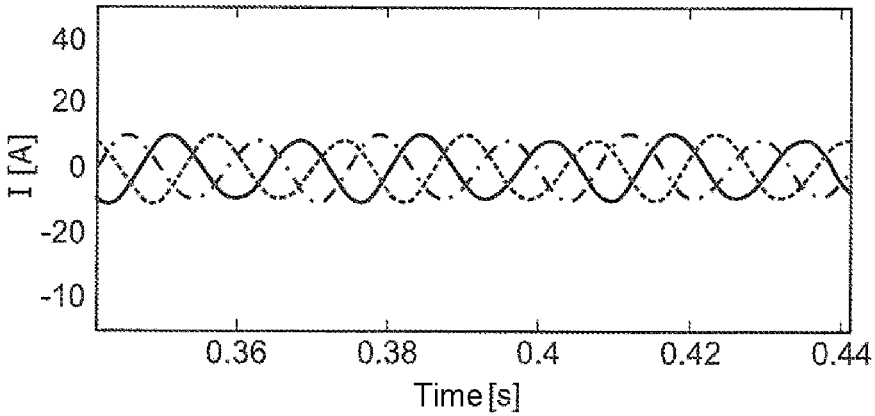
FIG. 5 shows a graphic representation of the time-based profile of the phase currents of a three-phase motor as a drive according to the first embodiment.

FIG. 5 shows the time-based profile of the phase currents with respect to the three phases of the three-phase motor, which, on account of the almost complete control-system vibration compensation, also turns out here to be quite a uniform respective sine curve.

Figure 6:
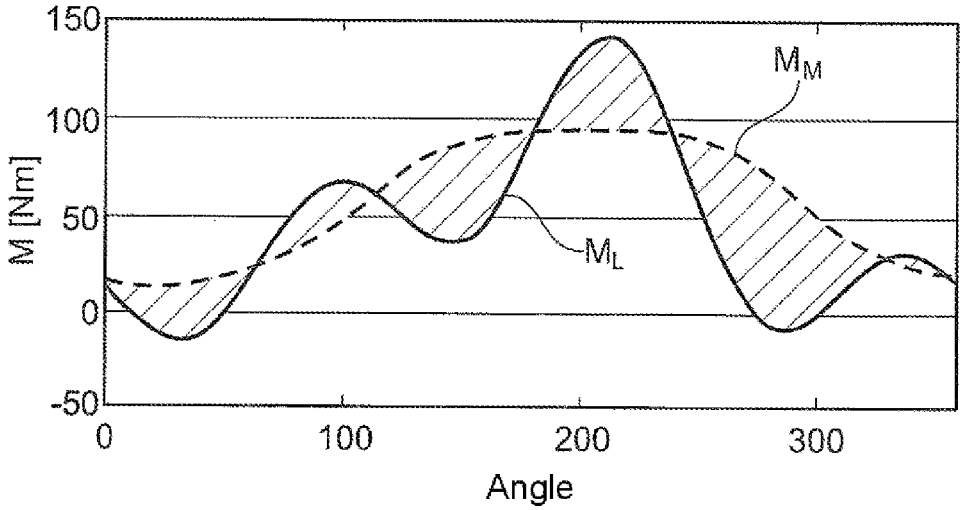
FIG. 6 shows a graphic representation of the rotational vibrations produced by the motor and the compressor according to the solution according to the disclosed embodiments with regard to a second embodiment.

FIG. 6 illustrates with regard to the second embodiment the torque profile of the torque $M_M$ and of the load moment $M_L$ for a full revolution of the crankshaft, though, by contrast with the embodiment described above, here there is only a compensation with regard to the first order of the load moment profile of the piston compressor by the torque $M_M$ of the three-phase motor. This has the result that, in comparison with the prior art explained above, a much smaller and uniformly distributed area content as a hatched area between the curves of the profile of the motor torque $M_M$ of the rotational speed motor and the load moment $M_L$ of the piston converter contributes to a vibration excitation. The vibration compensation achieved in this way can be regarded as sufficient for the application that is the subject of the disclosed embodiments.

Figure 7:
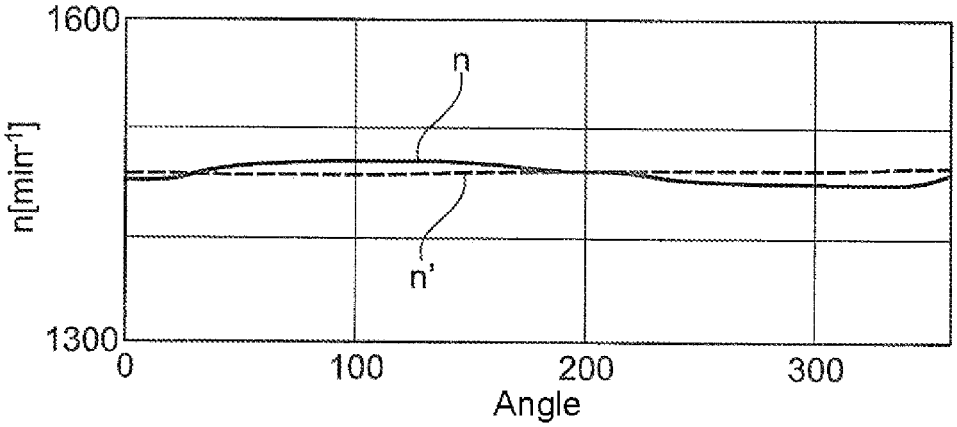
FIG. 7 shows a graphic representation of the speed profile in the case of the second embodiment.

FIG. 7 shows as a consequence of this that the rotational speed n of the crankshaft only fluctuates slightly about the average speed n'. A further uniformity of the speed profile can therefore be achieved here by the compensation of the first order of the load moment profile of the piston compressor.

Figure 8:
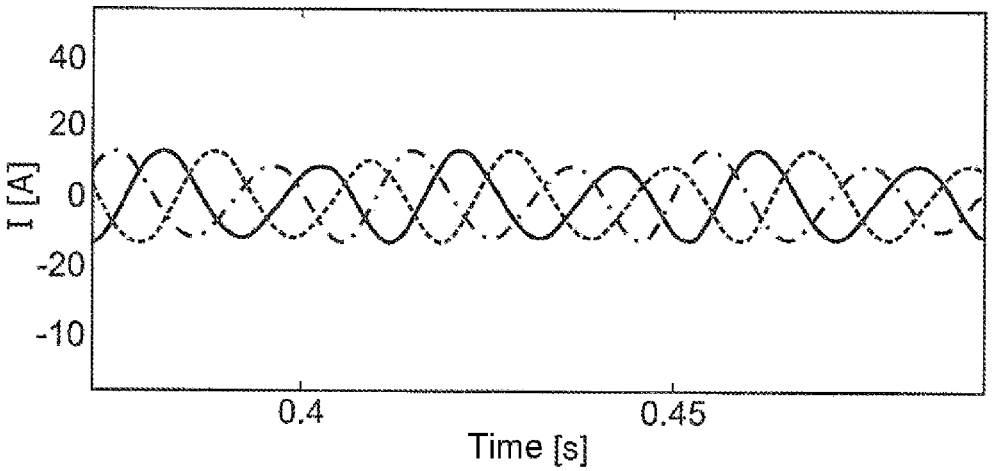
FIG. 8 shows a graphic representation of the time-based profile of the phase currents of a three-phase motor as a drive according to the second embodiment.

FIG. 8 accordingly shows the time-based profile of the phase currents of the three phases of the three-phase motor, which, by contrast with the almost complete compensation of the disclosed embodiments that is discussed above, does in fact reveal a slight non-uniformity. Nevertheless, the phase current profile stays within narrow limits, which demonstrates the effect of the solution according to the disclosed embodiments according to the second embodiment.

The disclosed embodiments are not restricted to the specific embodiments described above. Rather, modifications thereof that are included within the scope of the following claims are also conceivable. For example, instead of a two-stage piston-type compressor, it is also possible to also equip a single-stage piston-type compressor with the control-system vibration compensation according to the disclosed embodiments.

LIST OF DESIGNATIONS

1 Piston compressor
2 Three-phase motor
3 Low-pressure cylinder
4 High-pressure cylinder
5 Crankshaft
6 Frequency converter
7 Three-phase source
8 Control unit
9 Position sensor
$M_L$ Load moment of piston compressor
$M_M$ Torque of three-phase motor
n Rotational speed
n' Average speed

The invention claimed is:

1. A method for vibration compensation in a piston compressor, the method comprising:

driving the piston compressor by a crankshaft of a three-phase motor controlled by a frequency converter, the piston compressor and three-phase motor coupled without intervening flywheel masses, the piston compressor having a resilient mounting; and determining the current position of the crankshaft of the piston compressor, wherein based on the determined current position of the crankshaft, a torque ($M_M$) that follows a load moment ($M_L$) of the piston compressor is prescribed by the frequency converter for the three-phase motor to reduce vibration excitation of the piston-type compressor as a whole, wherein the torque ($M_M$) prescribed for the three-phase motor corresponds to the first order of a load moment profile of the piston compressor, wherein, to compensate for fluctuations in speed, the torque ($M_M$) generated by the three-phase motor is produced by the frequency converter with an increased pulse width for a period of time, and wherein, to compensate for fluctuations in speed, a torque requirement to be adjusted according to rotational speed is stored in logic of a control unit implemented by the frequency converter, wherein the current angular position of the crankshaft of the piston compressor is determined by sensors and prescribed to the control unit by the sensors as a current crankshaft position, and wherein a deviation of the load moment (ML) of the piston compressor is set to only approximately follow the torque ($M_M$) for the three-phase motor, wherein the deviation range is selected from a range of less than 30% and vibration behavior is improved by the vibration compensation by up to 70%.

2. The method of claim 1, wherein an increase of the torque ($M_M$) for the three-phase motor is carried out by a corresponding increase of its operating voltage by the frequency converter.

3. The method of claim 1, wherein, to compensate for fluctuations in speed, the torque ($M_M$) generated by the three-phase motor is produced by the frequency converter by a variation of the feed voltage and/or a variation of the pulse width.

4. An apparatus for vibration compensation in a piston compressor which is driven by a crankshaft by a three-phase motor controlled by a frequency converter, the apparatus comprising:

a control unit that determines the current position of the crankshaft of the piston compressor, wherein, based on this, the frequency converter prescribes a torque ($M_M$) that corresponds to the load moment ($M_L$) of the piston compressor for the three-phase motor to reduce vibration excitation of the piston-type compressor as a whole, wherein the torque ($M_M$) prescribed for the three-phase motor corresponds to the first order of a load moment profile of the piston compressor, wherein, to compensate for fluctuations in speed, the torque ($M_M$) generated by the three-phase motor is produced by the frequency converter with an increased pulse width for a period of time, and wherein, to compensate for fluctuations in speed, a torque requirement to be adjusted according to rotational speed is stored in logic of the control unit implemented by the frequency converter, wherein the current angular position of the crankshaft of the piston compressor is determined by sensors and prescribed to the control unit by the sensors as a current crankshaft position, and wherein a deviation of the load moment ($M_L$) of the piston compressor is set to only approximately follow the torque ($M_M$) for the three-phase motor, wherein the deviation is selected from a range of less than 30% and vibration behavior is improved by the vibration compensation by up to 70%.

5. The apparatus of claim 4, wherein the control unit is integrated in the frequency converter, which is arranged in or on the three-phase motor.

6. A piston compressor for producing compressed air for a vehicle, the compressor comprising:

a piston compressor which is driven by a crankshaft by a three-phase motor controlled by a frequency converter; and an apparatus for vibration compensation in the piston compressor, the apparatus comprising a control unit that determines the current position of the crankshaft of the piston compressor, wherein, based on this, the frequency converter prescribes a torque ($M_M$) that corresponds to the load moment ($M_L$) of the piston compressor for the three-phase motor to reduce vibration excitation of the piston-type compressor as a whole, wherein the torque ($M_M$) prescribed for the three-phase motor corresponds to the first order of a load moment profile of the piston compressor, wherein, to compensate for fluctuations in speed, the torque ($M_M$) generated by the three-phase motor is produced by the frequency converter with an increased pulse width for a period of time, and wherein, to compensate for fluctuations in speed, a torque requirement to be adjusted according to rotational speed is stored in logic of a control unit implemented by the frequency converter, wherein the current angular position of the crankshaft of the piston compressor is determined by sensors and prescribed to the control unit by the sensors as a current crankshaft position, and wherein a deviation of the load moment ($M_L$) of the piston compressor is set to only approximately follow the torque ($M_M$) for the three-phase motor, wherein the deviation is selected from a range of less than 30% and vibration behavior is improved by the vibration compensation by up to 70%.

* * * * *